US009676519B2

(12) United States Patent
Patel

(10) Patent No.: US 9,676,519 B2
(45) Date of Patent: Jun. 13, 2017

(54) DISPENSER

(71) Applicant: Abdul Ebrahim Patel, London (GB)

(72) Inventor: Abdul Ebrahim Patel, London (GB)

( * ) Notice: Subject to any disclaimer, the term of this patent is extended or adjusted under 35 U.S.C. 154(b) by 0 days.

(21) Appl. No.: 15/148,797

(22) Filed: May 6, 2016

(65) Prior Publication Data

US 2016/0332779 A1 Nov. 17, 2016

(30) Foreign Application Priority Data

May 14, 2015 (GB) ..... 1508261.3

(51) Int. Cl.
*B65D 23/00* (2006.01)
*B05B 11/00* (2006.01)
*A47K 5/12* (2006.01)

(52) U.S. Cl.
CPC ..... *B65D 23/001* (2013.01); *B05B 11/0037* (2013.01); *A47K 2005/1218* (2013.01)

(58) Field of Classification Search
CPC ..... B65D 23/001; B05B 11/0037; A47K 2005/1218
USPC ..... 222/321.1, 321.7–321.9, 383.1, 383.3, 222/402.1, 173
See application file for complete search history.

(56) References Cited

U.S. PATENT DOCUMENTS 5,148,948 A 9/1992 Granville
6,520,470 B1 * 2/2003 Chan ..... A47K 5/12 215/376
8,302,819 B2 * 11/2012 Dente ..... A61L 9/12 222/153.01
2006/0144861 A1 * 7/2006 Harrison ..... A47K 5/12 222/173
2015/0313419 A1 11/2015 Patel

FOREIGN PATENT DOCUMENTS

GB 2414466 A 11/2005
GB 2495716 A 4/2013

OTHER PUBLICATIONS

UK Patent Application GB1508261.3; Search Report dtd Oct. 25, 2016.

* cited by examiner

*Primary Examiner* — Donnell Long
(74) *Attorney, Agent, or Firm* — Schwabe Williamson & Wyatt, P.C.

(57) ABSTRACT

A dispenser bottle assembly (12) is adapted for attachment to a mounting base (14) fixed to a surface. The assembly (12) includes a dispenser bottle (24) having a base and a projection extending outwardly from the base, an externally threaded collar (28) mounted for rotation about the projection, and a drive member (26) mounted about the projection between the collar and the base of the bottle. The threaded collar (28) is received in a threaded recess (18) in the mounting base to secure the bottle to the base. Corresponding formations on the drive member (26), the base and the collar (28) allow the collar to be screwed into and out of the mounting base (14) by rotating the bottle whilst allowing a limited degree of rotational freedom between the bottle and the collar so that the angular orientation of the bottle can be adjusted after fitting.

15 Claims, 9 Drawing Sheets

DISPENSER

CROSS-REFERENCE TO RELATED APPLICATIONS

The present application claims priority to U.K. Patent Application No. 1508261.3, filed May 14, 2015, entitled "Dispenser," the disclosure of which is hereby incorporated by reference in its entirety for all purposes except for those sections, if any, that are inconsistent with this specification.

TECHNICAL FIELD OF THE INVENTION

The present invention relates to a liquid dispenser and in particular to a liquid dispenser including dispenser bottle assembly for mounting to a surface.

BACKGROUND TO THE INVENTION

It is known to mount a liquid dispenser to a fixed surface for use in mobile passenger carriers such as tour buses, aeroplanes and water craft.

U.S. Pat. No. 5,148,948 discloses a dispenser for liquid soap which includes a mounting base for securing to a horizontal surface such as counter top in a washroom and a bottle with a dispensing arrangement for holding and dispensing liquid soap which is removably mountable to the mounting base. In an embodiment, the mounting base has a cup member with an internal thread and the bottle has a protrusion on its base with a corresponding external thread. The dispenser bottle is secured to the base by screwing the protrusion into the cup member. This arrangement secures the bottle to the fixed surface so that it is not thrown around by movement of the carrier but allows for removal of the bottle for replacement or refilling.

In confined washrooms, such as airplane toilets, noxious odours can be unpleasant. To help overcome this problem in a convenient manner, it is known to combine an air freshener with a liquid soap dispenser. GB 2414466 A discloses a combined soap and air freshener dispenser which has a similar mounting arrangement to that disclosed in U.S. Pat. No. 5,148,948.

Use of a common mounting arrangement is advantageous as it allows a range of different dispensers to be mounted using the same type of mounting base. In many passenger carriers, especially aircraft, the screw type mounting base has become a commonly used fitting. However, the position of the threads of the mounting base can vary from aircraft to aircraft, resulting in the known dispenser bottles being mounted in unpredictable rotational orientations. This problem has been overcome in the past by using dispenser bottle assemblies which are substantially symmetrical so that they look the same in any rotational orientation. This though severely restricts the design and construction for an effective product. For example, it can be advantageous for a dispenser to have air freshener components mounted only to one side of the bottle, giving rise to a non-symmetrical design. Where a dispenser bottle assembly is not rotationally symmetrical, it is desirable that it can be positioned in a particular rotational orientation. For example, it may be desirable that the dispenser bottle is positioned so that the air freshener faces away from the user at the rear with any brand labelling towards the front.

GB2495716 A discloses a combined liquid soap and air freshener dispenser having the air fresher on one side of the soap bottle and which includes a screw thread arrangement that allows the rotational orientation of the bottle to be adjusted after is it mounted to a mounting base. The bottle has a generally cylindrical projection extending from its base, the projection having a radial ridge or lip at its lower end. A threaded collar is mounted to the projection and is retained by the ridge. The collar has an external thread for engagement with the internal thread in a mounting base and can rotate about the projection. The collar and the bottle have corresponding abutments which come into contact at specific relative rotational orientations between the two so as to limit the freedom of the collar to rotate about the projection in either direction. To mount the dispenser bottle assembly, the projection and collar are inserted into the threaded cup in the mounting base. The bottle is rotated in a first direction to screw the collar into the base, typically this is a clockwise direction. The bottle projection initially rotates within the collar until the abutments come into contact. Further rotation of the bottle in the first direction causes the collar to be rotated in the same direction due to engagement of the abutments and screws the collar into the mounting base. Once the collar is tight in the base, the rotational orientation of the bottle can be adjusted by turning it in the opposite direction. The abutments are arranged so that the bottle can be rotated by a significant amount in the opposite direction, almost up to 360 degrees, before the abutments come into contact again. This provides a high degree of rotational freedom to reposition the bottle. To remove the bottle from the mounting base, the bottle is rotated in the opposite direction. As the bottle is rotated, the abutments will again come into contact but on the opposite sides and continued rotation of the bottle rotates the collar so that it is unscrewed from the base.

The dispenser bottle mounting arrangement as disclosed in GB2495716 A firmly secures the dispenser bottle to the mounting base whilst allowing a significant degree of rotational freedom of the mounted bottle for repositioning. Whilst the arrangement works well, it has been found that under certain circumstances the abutment on the collar may slip over the abutment on the bottle so that the bottle can be rotated fully through 360 degrees without the abutments engaging correctly to drive the collar. This can result in an inability to correctly mount the bottle to a mounting base and/or an inability to remove a bottle after it has been mounted.

There is a need then for an improved dispenser bottle assembly which overcomes, or at least mitigates, some or all of the disadvantages of the known dispenser bottle assemblies.

In particular, there is a need for an improved dispenser bottle assembly which can be reliably mounted/de-mounted to a screw threaded mounting base and which can be rotationally repositioned when mounted.

SUMMARY OF THE INVENTION

According to a first aspect of the invention, there is provided a dispenser bottle assembly comprising: a dispenser bottle having a base and a projection extending outwardly from the base; an externally threaded collar mounted for rotation about the projection; and a drive member mounted about the projection between the collar and the base of the bottle, the drive member and one of the bottle and the collar having corresponding formations which cooperate to hold the drive member rotationally fast with said one of the bottle and the collar, the drive member and the other of the bottle and the collar having corresponding abutments which contact one another at specific relative rotational orientations so that the drive member and said other of the bottle and the collar have a limited degree of rotational freedom relative to one another.

The corresponding abutments may be configured so that the drive member and said other of the bottle and the collar are able to rotate relative to one another through a range of at least 270 degrees but less than 360 degrees, or more preferably through a range of at least 300 degrees but less than 360 degrees, or even more preferably a range of at least 350 degrees but less than 360 degrees, or yet more preferably through a range of at least 355 degrees but less than 360 degrees.

In an embodiment the corresponding formations comprise a recess in the base of the bottle and a corresponding lug on the drive member which is received in the recess. The corresponding formations may comprise two recesses in the base of the bottle and two lugs on the drive member, each lug being received in a respective one of the recesses.

In an embodiment, the drive member comprises an annular disc which locates about the projection, the disc having a first opposed surface directed toward the base of the bottle and a second opposed surface directed toward the collar, at least one said formation being associated with one of the opposed surfaces of the disc and at least one said abutment being associated with the other of said opposed surfaces. Where the formation comprise a recess in the base of the bottle and a corresponding lug on the drive member, the, or each, lug may project beyond the first opposed surface of the disc and the at least one abutment may project beyond the second opposed surface of the disc. The collar may have an annular surface aligned generally parallel to and facing the second opposed surface, an abutment projecting from the annular surface of the collar towards the second opposed surface of the disc. In which case, the abutment on the collar may be circumferentially offset from the abutment on the disc, the two abutments configured to contact one another to limit relative rotational movement between the collar and the member.

An air freshener dispenser may be incorporated into the bottle. The dispenser bottle may have a main chamber for holding a liquid to be dispensed and a secondary chamber for holding an air freshener.

In accordance with a second aspect of the invention, there is provided a dispenser bottle assembly comprising: a dispenser bottle having a base and a projection extending outwardly from the base; an externally threaded collar mounted for rotation about the projection; and a drive member in the form of an annular disc mounted about the projection between the collar and the base of the bottle, the disc having a first opposed surface directed toward the base of the bottle and a second opposed surface directed toward the collar, the base of the bottle defining at least one recess and the drive member having a corresponding lug on said first opposed system receivable in the recess to hold the drive member rotationally fast with the bottle; the disc having a first collar drive abutment on said second opposed surface which engages a corresponding second collar drive abutment on the collar only at specific relative rotational orientations of the drive member and the collar.

In accordance with a third aspect of the invention, there is provided a dispenser comprising a dispenser bottle assembly in accordance with the first aspect and a mounting base for attachment to a surface, the mounting base having a recess with an internal thread into to which the threaded collar can be screwed to mount the dispenser bottle to the mounting base. The dispenser may have a liquid dispensing pump mounted to the bottle for dispensing a liquid contained in the bottle.

DETAILED DESCRIPTION OF THE INVENTION

In order that the invention may be more clearly understood an embodiment thereof will now be described, by way of example only, with reference to the accompanying drawings, of which:

A dispenser 10 in accordance with an aspect of the invention comprises a dispenser bottle assembly 12 in accordance with a further aspect of the invention and a mounting base 14.

Figure 1:
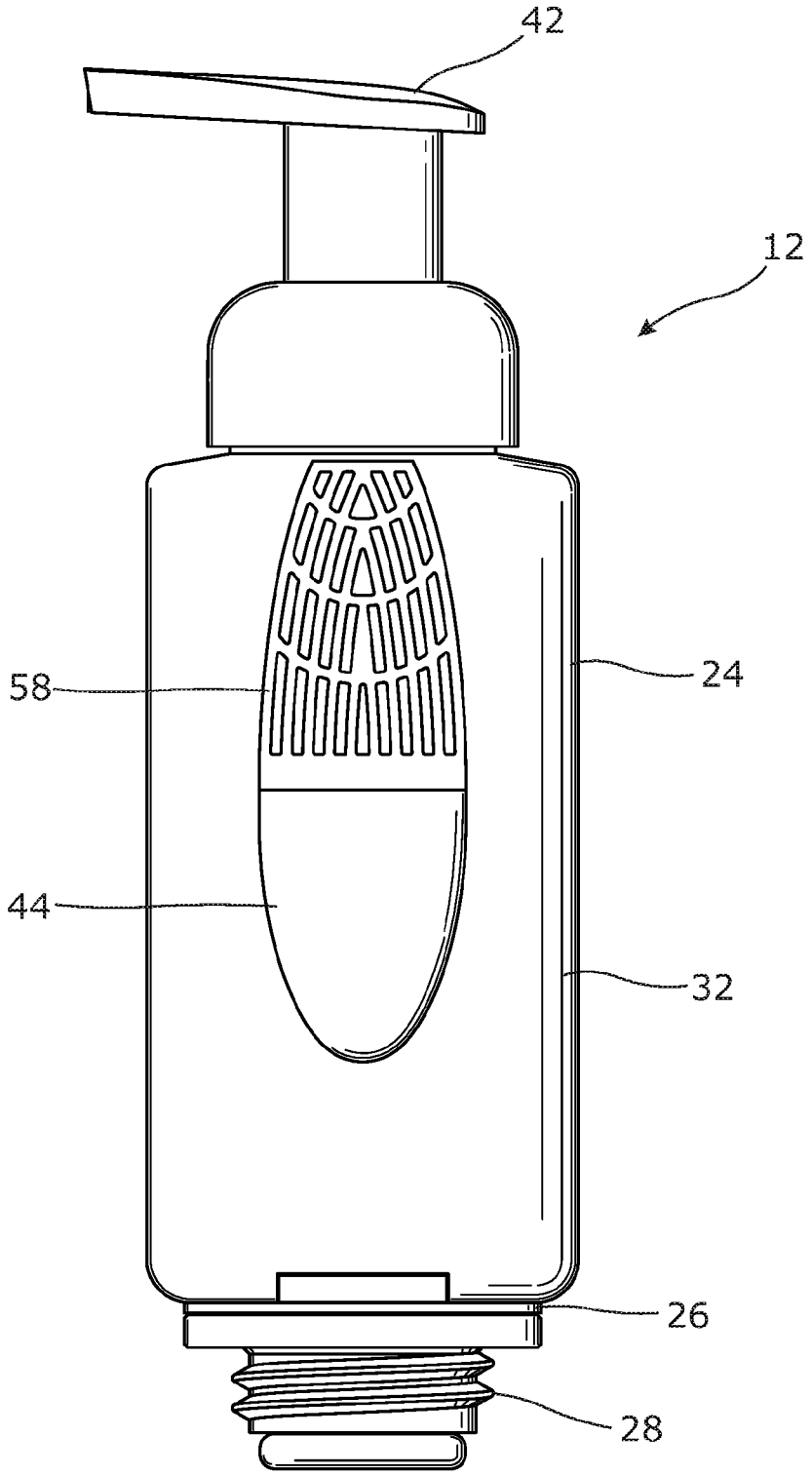
FIG. 1 is a side view of a dispenser bottle assembly in accordance with an embodiment of the invention.
Figure 2:
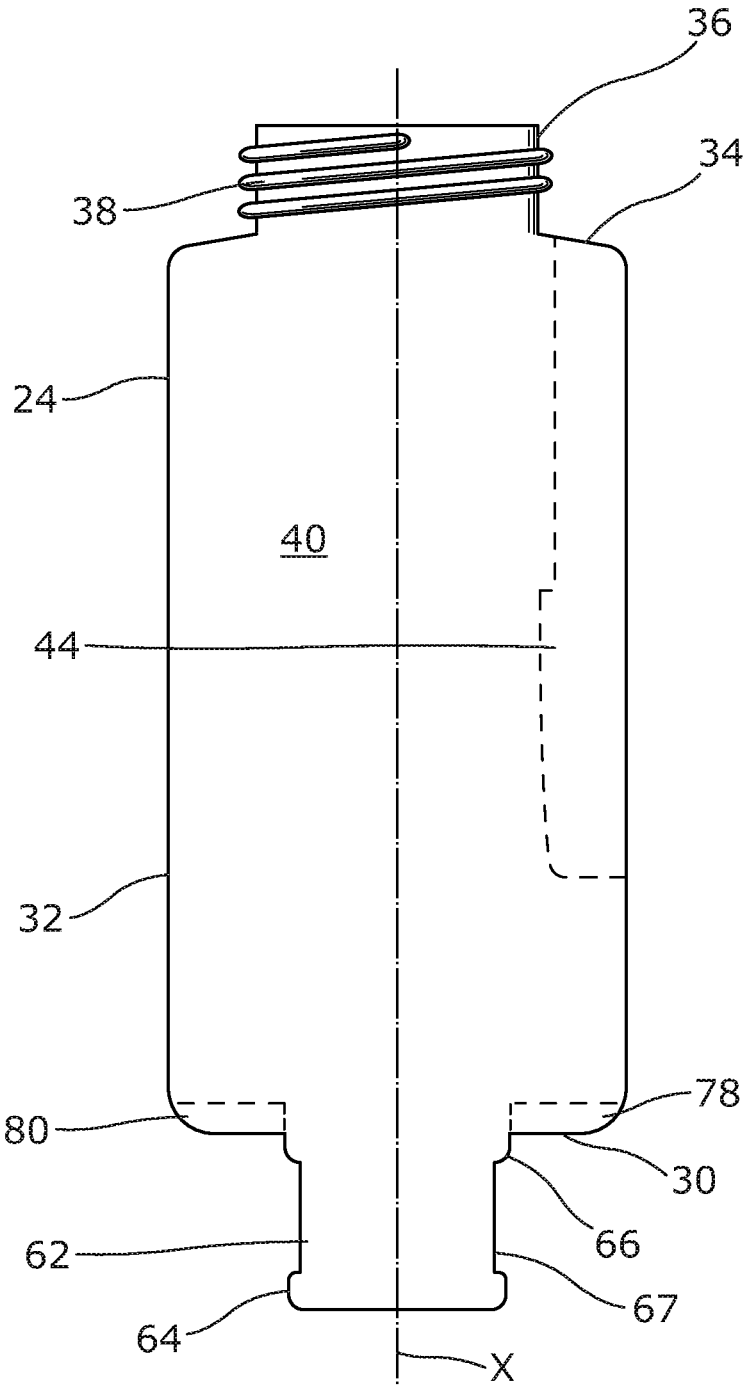
FIG. 2 is a front view of a dispenser bottle forming part of the dispenser bottle assembly of FIG. 1.
Figure 3:
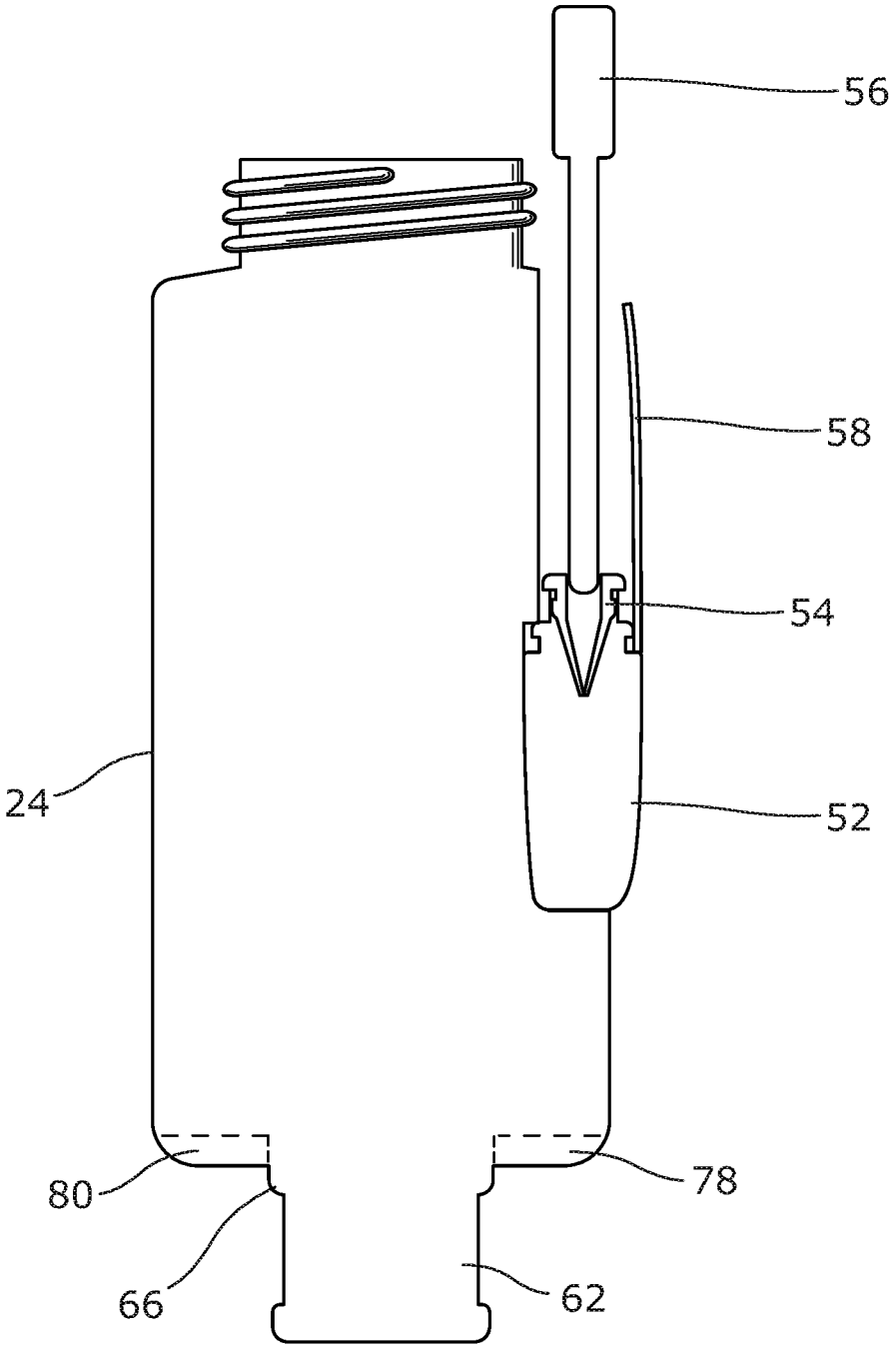
FIG. 3 is a front view of the dispenser bottle assembly of FIG. 1 but showing internal details of an air freshener dispensing arrangement.
Figure 4:
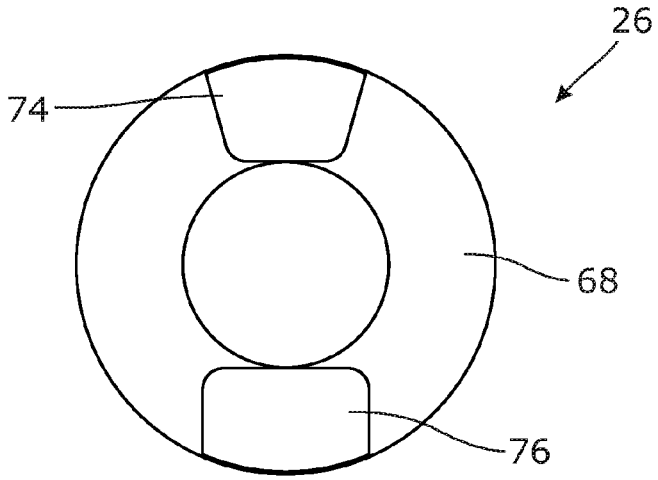
FIGS. 4, 5 and 6 are a plan view from above, a side view, and a plan view from below respectively of a drive member forming part of the dispenser bottle assembly of FIG. 1.
Figure 5:
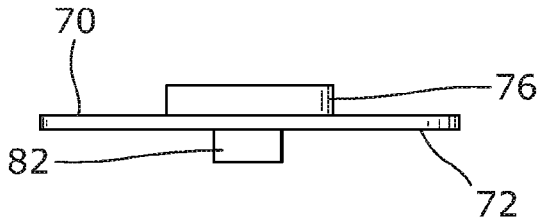
Figure 6:
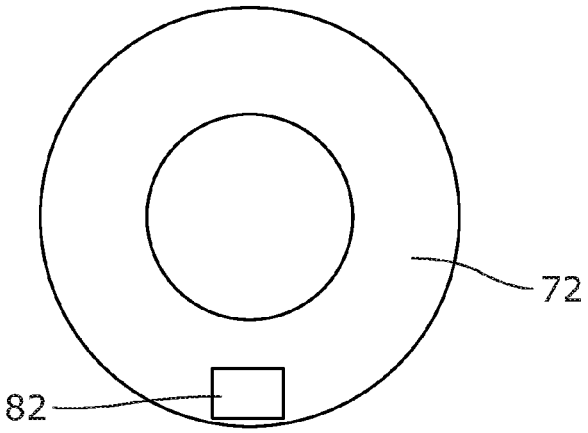
Figure 7:
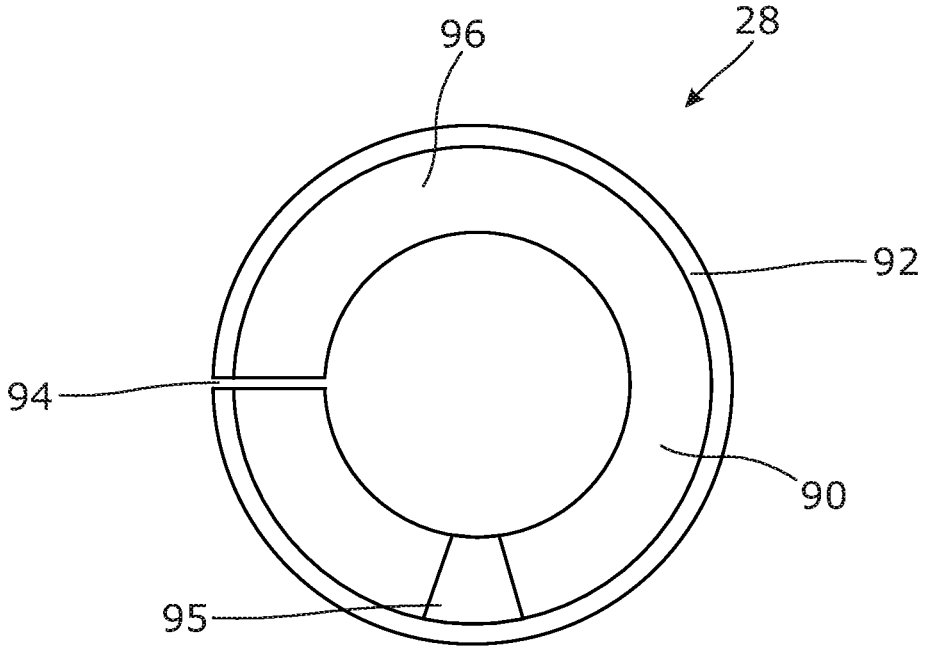
FIGS. 7 and 8 are a plan view from above and a side view respectively of a threaded collar forming part of the dispenser bottle assembly of FIG. 1.
Figure 8:
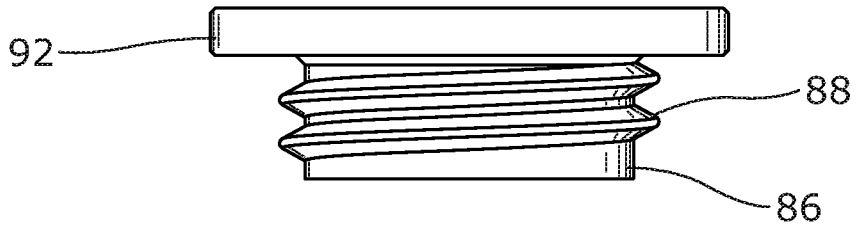
Figure 9:
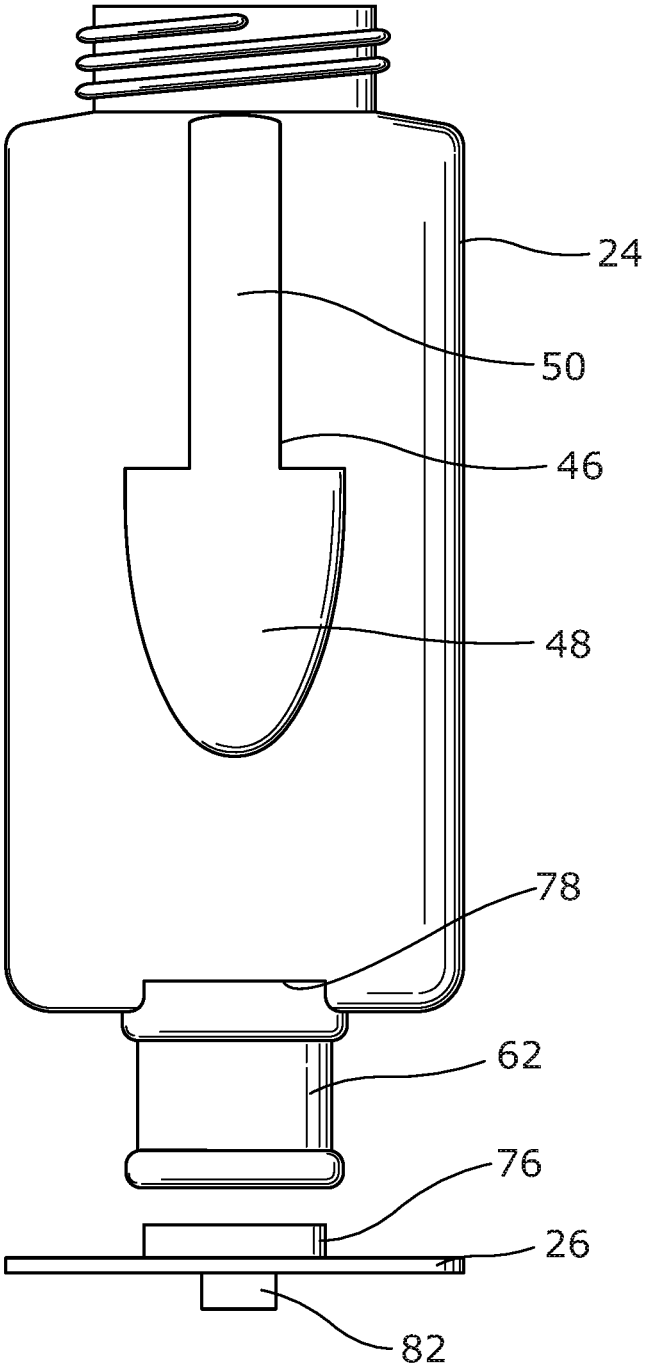
FIG. 9 is an exploded view of the bottle of FIG. 2 and the drive member of FIGS. 4 to 6 prior to fitment of the drive member to the bottle.
Figure 10:
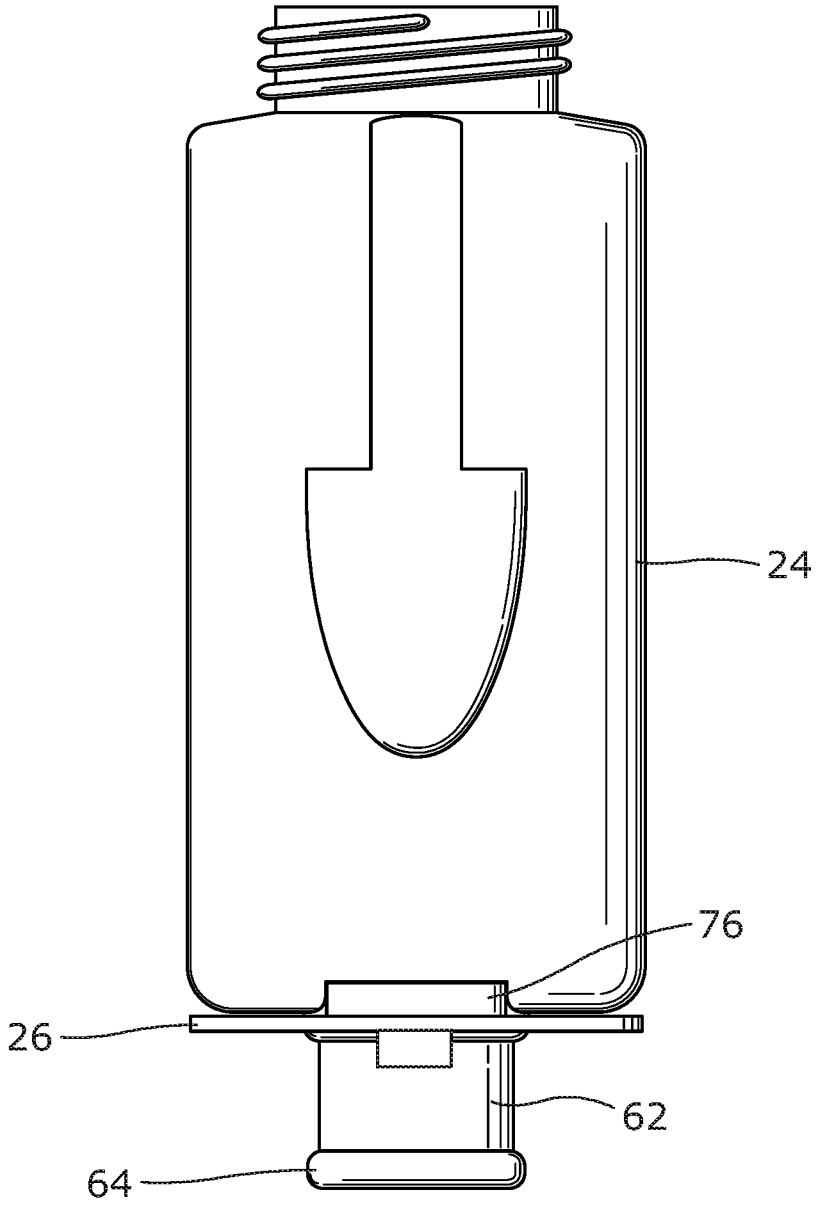
FIG. 10 is a view of the bottle of FIG. 2 and the drive member of FIGS. 4 to 6 fitted to the bottle.
Figure 11:
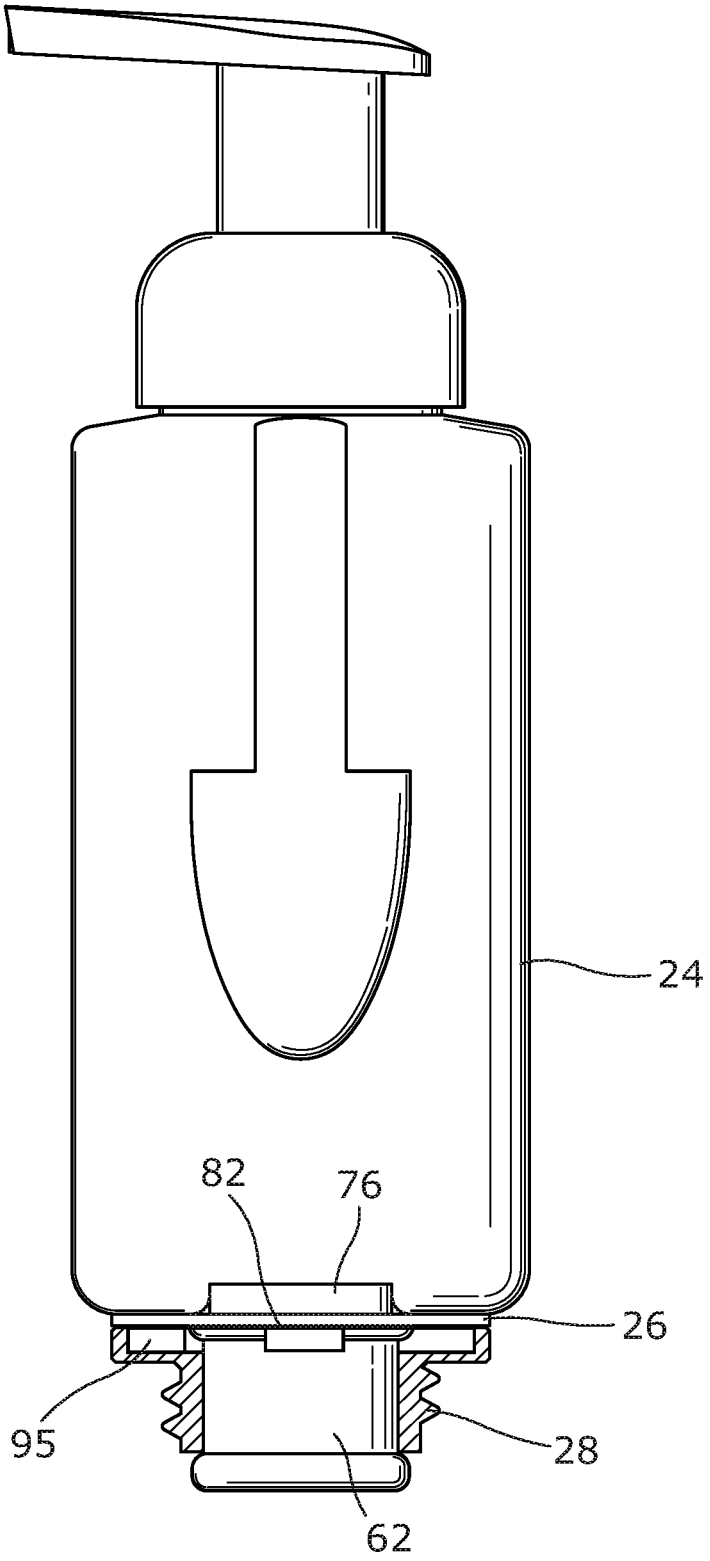
FIG. 11 is a view similar to that of FIG. 10 but also showing the threaded collar of FIGS. 7 and 8 and a dispenser pump fitted to the bottle, the collar being shown partly in section; and, FIG. 12 is a side view of a dispenser comprising the dispenser bottle assembly of FIG. 1 secured to a mounting base, in which the mounting base is shown in section.
Figure 12:
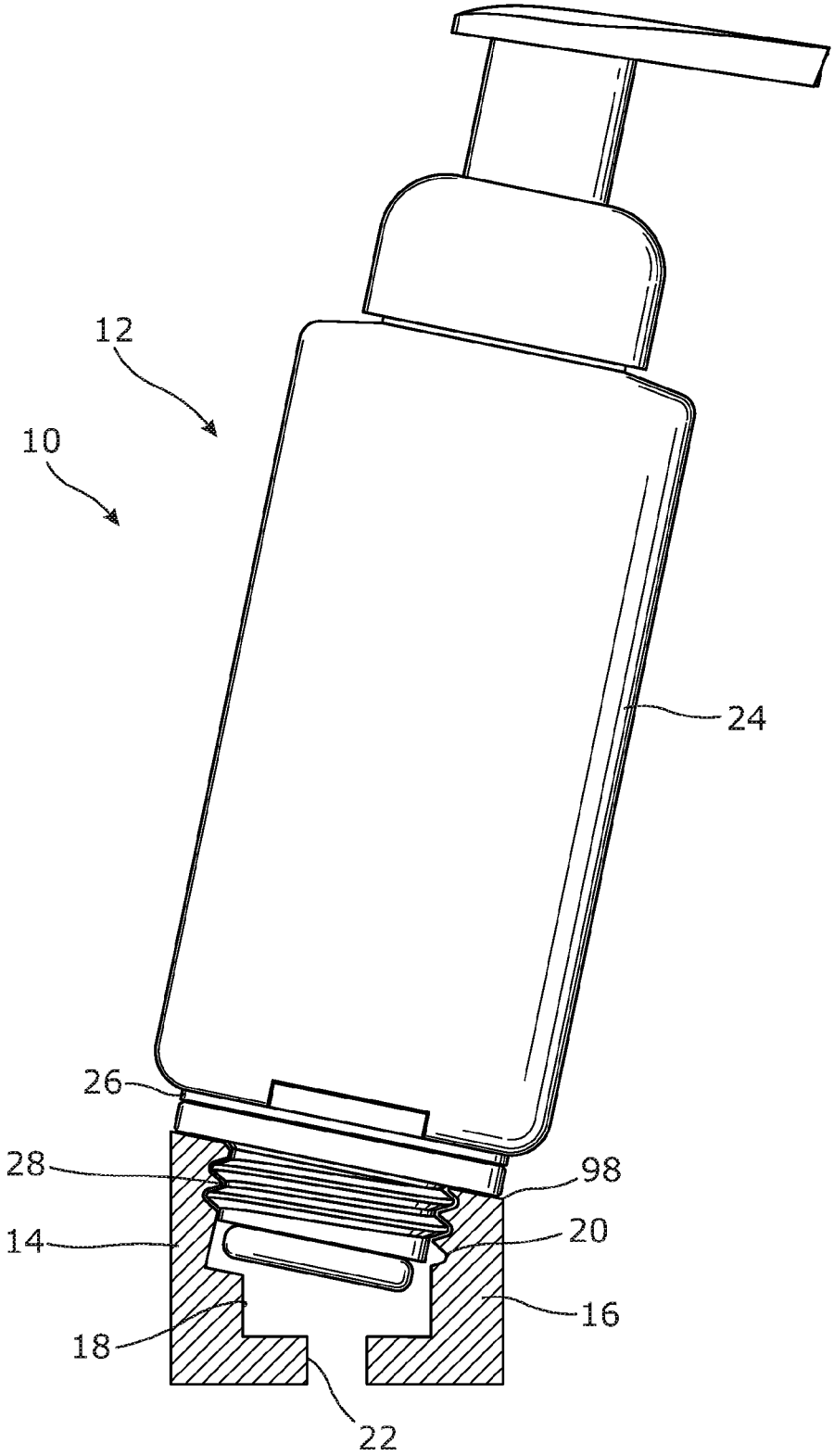

As illustrated in FIG. 12, the mounting base 14 has a body 16 with a generally cylindrical recess or cup 18 with an internal thread 20. The body 16 has a mounting hole 22 in a lower wall 17 of the body by means of which it can be firmly secured to a suitable surface by means of a fastener (not shown). The mounting base 14 is typically secured to a generally horizontal surface such as a counter top surrounding a washbasin in a washroom of a mobile passenger carrier such as an aircraft or coach or the like. However, the invention is not limited to application in mobile passenger carriers.

The dispenser bottle assembly 12 includes a dispenser bottle 24, a drive member 26 and a threaded collar 28.

The dispenser bottle 24 has a base 30, a substantially cylindrical side wall 32 extending upwardly from the base and a top 34 including a neck opening 36 with an external thread 38. The interior of the bottle 24 defines a main chamber 40 for holding a liquid to be dispensed which can be accessed via the neck opening 36. Typically, it is expected that the dispenser bottle assembly 12 will be used to dispense a liquid soap from the main chamber. However, the dispenser could be used to dispense other liquid products including but not limited to products such as hand cream, cleansing gel or the like. The term liquid should therefore be understood as encompassing a cream or gel or any similar type of flowable product which can be dispensed from a bottle. In the present embodiment, a conventional manual dispenser pump arrangement 42 is mounted to the bottle by means of the threaded neck in a known manner to dispense the liquid in the main chamber 40. Other suitable dispensing pump arrangements could be used, including electric powered dispenser pumps for example.

The dispenser bottle assembly 12 has an air freshener dispenser 44 mounted to the outside of the bottle 24 on one side. A spoon shaped groove or indentation 46 is formed on the outer surface of the side wall 32. The groove has a pocket shaped lower region 48 and a narrower elongate region 50 extending upwardly from the pocket shaped region. The air freshener dispenser 44 has a pouch-like container 52 which is located in the pocket shaped region 48 of the groove. The container 52 defines an internal volume for holding a liquid air freshener composition. The container has an opening at its upper end which closed by means of a duck-billed valve 54 to retain the liquid air freshener composition inside. To dispense the air freshener, a wick 56 is inserted into the composition through the valve 54. An upper region of the wick extends along the side of the bottle within the elongate region 50 of the groove 46. When the wick 56 is inserted, the air freshener composition travels up the wick from where it evaporates into the atmosphere. A vented plate 58 is attached to the upper end of the container 52 and extends upwardly to cover the elongate region 50 of the groove and the wick 56. The plate 58 has vent holes 60 to allow air to circulate about the wick.

Whilst the present invention is particularly advantageous for use with dispenser bottle assemblies incorporating an air freshener dispenser 44 non-symmetrically disposed on one side of the bottle, the nature of the air freshener dispenser itself does not form a part of the present invention and other air freshener dispensing arrangements could be adopted. For example an air freshener dispenser which holds a solid air freshener composition could be used. Indeed, the invention is not limited to dispensers and dispenser bottle assembles in which an air freshener dispenser is non-symmetrically disposed about the bottle but can be adopted in dispensers which have a symmetrical air freshener arrangement or which do not incorporate an air freshener dispenser at all.

A cylindrical projection 62 projects outwardly (downwardly when the bottle is upright) from the base 30 of the bottle. The projection has a longitudinal axis X, which in this embodiment is concentric with a longitudinal axis of the remainder of the bottle. The projection has a first radial lip 64 at its end distal from the base 30 and a second radial lip 66 at is end proximal the base 30. The first and second radial lips 64, 66 have similar outer diameters which are larger than the outer diameter of a central portion 67 of the 62 projection in between the two lips.

The drive member 26 comprises an annular disc 68 which is mounted about the projection 62 of the bottle. It has an internal diameter which is a close sliding fit about the second radial lip 66 proximal to the base 30 of the bottle. The disc 68 has a first opposed surface 70 which is directed towards the base 30 of the bottle and a second opposed surface 72 which is directed away from the base 30 when the drive member is assembled to the bottle. A pair of drive lugs 74, 76 project from the first opposed surface 70 of the disc. The lugs 74, 76 are diametrically opposed on the disc and are configured to engage snugly in a corresponding pair of recesses 78, 80 in the base 30 of the bottle. Engagement of the lugs 74, 76 in the recesses 78, 80 holds the drive member 24 fast with the bottle for rotation about the longitudinal axis X of the projection 54. A first collar driving abutment 82 projects outwardly from the second opposed surface 72 of the disc. The first collar driving abutment 82 occupies only a relatively small circumferential extent of the disc.

The threaded collar 38 is mounted about the projection below the drive member 26 and is held axially in position by first radial lip 64. The collar has cylindrical tubular portion 86 having an external thread 88 which mates with the internal thread 20 in the mounting base. The threads 88, 20 are right-hand threads configured so that the collar 28 is rotated in a clockwise direction when looking from above in order to screw it into the base 14 and is rotated anticlockwise to unscrew it from the base. It will be appreciated though that a left hand thread could be used in which case the directions of rotation to screw and unscrew the collar as described herein will be reversed. A flange 90 extends radially outwardly from the end of the tubular portion 86 proximal to the base 30 of the bottle. A lip 92 projects axially towards the base of the bottle about the outer edge of the flange 90.

To allow the collar 28 to be fitted about the projection, it has an axial split 94 and is made of a resilient, but relatively hard material such as PET. In its relaxed state, the inner diameter of the collar 28 is smaller than the outer diameter of the radial lip 64 on the projection but the split allows the collar to be expanded radially to allow it to pass over the first radial lip 64. Once past the lip 64, the collar retracts radially and is a close sliding fit about the central portion 67 of the projection. The collar 28 is held axially in position on the projection by engagement of the first radial lip 64 with the end of the tubular portion opposite from the flange 90. The outer diameter of the radial flange 90 and lip 92 are substantially the same as the outer diameter of the annular disc 68 of the drive member. When the threaded collar is fitted to the projection, the upper surface of the lip 92 abuts an outer diameter portion of the second opposed surface 72 of the disc and holds the first opposed surface 70 of the disc in contact with the base 30 of the bottle. This holds the lugs 74, 76 firmly their respective recesses 78, 80 with the radial flange 90 spaced by the depth of the lip 92 from the disc 68.

A second collar drive abutment 95 projects upwardly from the surface 96 of the flange 90 proximal to the disc 68 and is received in the gap between the flange and the disc. The second collar drive abutment 95 occupies only a relatively small circumferential extent of the flange 92. When the threaded collar 28 and drive member 26 are mounted to the projection, the first and second collar drive abutments 82, 95 are offset circumferentially and both are located in the gap between the flange 90 and the disc 68. The two collar drive abutments 82, 95 overlap axially and radially so that side edges of the abutments come into contact with one another when the collar 28 and drive member 26 are rotated relative to one another about the longitudinal axis X of the projection. The abutments 82, 95 provide a limited degree of relative rotational freedom between the collar and the drive member. Ideally, the collar and the drive member are able to rotate relative to one another though a range of at least 270 degrees, or more preferably through a range of at least 300 degrees, or even more preferably a range of at least 350 degrees, or yet more preferably through a range of at least 355 degrees between positions at which the abutments 82, 95 come into engagement.

In order to mount a dispensing bottle assembly 12 to a mounting base 14, the projection 62 and threaded collar 28 are inserted into the recess 18 to engage the respective threads 18, 88. The bottle 24 is rotated about the axis X of the projection in a clockwise direction. As the bottle is rotated, the drive member 26 is constrained to rotate with the bottle 24 due to the engagement of the drive lugs 74, 76 in their respective recesses 78, 80. Initially, the drive member 26 and the bottle 24 may rotate about the axis X relative to the threaded collar 28 until the first collar driving abutment 82 is brought into contact with the second collar driving abutment 95 on one side. Once the abutments 82, 95 are in contact, further rotation of the bottle 24 and drive member 26 in the same direction will cause the threaded collar 28 to be rotated in the clockwise direction so that the collar is screwed into the mounting base 14. Once the threaded collar 14 is fully and firmly engaged in the mounting base 14, the bottle can be rotational re-positioned by turning it in the opposite, anti-clockwise, direction. This results in the drive member 26 rotating anti-clockwise with the bottle 24 so that the collar driving abutments 82, 95 separate from one another. The bottle can be rotated in the anti-clockwise direction until it is placed in a suitable rotational position. The amount of adjustment available is determined by range of movement between the drive member and the threaded collar between the collar driving abutments coming into contact in either rotational direction. Ideally, the collar driving abutments 82, 95 are configured so that the bottle 24 and drive member can be rotated through a significant range which is close to but less than 360 degrees between the collar driving abutments engaging to allow for maximum adjustment.

Whilst the bottle 24 can be rotated relative the threaded collar 28 and mounting base 14 to a limited extent, it is prevented from being removed axially from mounting base by engagement of the first radial lip 64 with the inner end of the tubular portion of the threaded collar 28. The collar 28 is prevented from expanding radially by its engagement in the mounting base so that the lip 64 cannot be drawn through the threaded collar.

In order to de-mount the bottle assembly 12 from the mounting base 14, the bottle is rotated anti-clockwise about the axis X of the projection until the first collar driving abutment 82 engages with the other side of the second collar driving abutment 95. Further rotation causes the threaded collar 28 to rotate anti-clockwise unscrewing it from the mounting base.

The mounting base 14 in the embodiment shown is arranged so that the bottle assembly 12 is angled relative to the plane of the surface on which the mounting base 14 is attached when it is fitted to the mounting base. To this end, the central axis of the thread 20 and the upper surface 98 of the body is angled relative to the plane of the lower wall 17 of the body. However, this need not be the case and the bottle assembly 12 and mounting base 14 could be configured so that the axis of the bottle assembly is perpendicular to the surface on which the mounting base is attached.

For the avoidance of doubt, references to rotation or relative rotation of the bottle assembly, the bottle, the drive member and/or the treaded collar refer to rotation about the axis X of the projection, this being the axis of rotation about which the collar is turned in order for it to be screwed into or out of the mounting base.

The components of the dispenser 10 can be made from any suitable materials but are typically made from plastics materials such as Polyethylene Terephthalate (PET), High Density Polyethylene (HDPE) or the like. In a preferred embodiment, the bottle is made from PET and is blow moulded from a preform.

The above embodiment is described by way of example only. Many variations are possible without departing from the scope of the invention as defined in the appended claims. For example, whilst in the present embodiment the drive member 26 is rotationally fast with the bottle 24 and has a limited degree of rotational freedom relative to the threaded collar 28, this arrangement could be reversed so that the drive member is held rotationally fast with threaded collar and has a limited degree of rotational freedom relative to the bottle to allow for repositioning of the bottle. It will also be appreciated that the corresponding formations which hold the drive member rotationally fast with the bottle, or with the threaded collar, could take many forms. Examples might include using more or less than two drive lugs and/or the lugs could be provided on the bottle/threaded collar to engage in recesses in the drive member.

Alternately or in addition, the inner opening of the drive member 26 and the corresponding region of the projection 62 could be shaped to hold the drive member 26 rotationally fast with the bottle. The second radial lip 66 could have flats which engage with corresponding flats provided on the inner opening of the drive member disc 68. Similarly, the driving abutments which allow for limited rotational freedom between the drive member 26 and the threaded collar/bottle 24 can take many different forms. In one alternative, an abutment might project from one of the drive member and the threaded collar/bottle for engagement in an arcuate slot in the other of the drive member and the threaded collar/bottle collar.

The invention claimed is:

1. A dispenser bottle assembly comprising: a dispenser bottle having a base and a projection extending outwardly from the base; an externally threaded collar mounted for rotation about the projection; and a drive member mounted about the projection between the collar and the base of the bottle, the drive member and one of the bottle and the collar having corresponding formations which cooperate to hold the drive member rotationally fast with said one of the bottle and the collar, the drive member and the other of the bottle and the collar having corresponding abutments which contact one another at specific relative rotational orientations so that the drive member and said other of the bottle and the collar have a limited degree of rotational freedom relative to one another.

2. A dispenser comprising a dispenser bottle assembly as claimed in claim 1 and a mounting base for attachment to a surface, the mounting base having a recess with an internal thread with which the threaded collar can be engaged to mount the dispenser bottle to the mounting base.

3. A dispenser as claimed in claim 2, further comprising a liquid dispensing pump mounted to the bottle for dispensing a liquid contained in the bottle.

4. A dispenser bottle assembly as claimed in claim 1, wherein the corresponding abutments are configured so that the drive member and said other of the bottle and the collar are able to rotate relative to one another through a range of at least 270 degrees but less than 360 degrees, or more preferably through a range of at least 300 degrees but less than 360 degrees, or even more preferably a range of at least 350 degrees but less than 360 degrees, or yet more preferably through a range of at least 355 degrees but less than 360 degrees.

5. A dispenser bottle assembly as claimed in claim 1, wherein the corresponding formations comprise a recess in the base of the bottle and a corresponding lug on the drive member which is received in the recess.

6. A dispenser bottle assembly as claimed in claim 1, wherein the corresponding formations comprise two recesses in the base of the bottle and two lugs on the drive member, each lug being received in a respective one of the recesses.

7. A dispenser bottle as claimed in claim 1, wherein the drive member comprises an annular disc which locates about the projection, the disc having a first opposed surface directed toward the base of the bottle and a second opposed surface directed toward the collar, at least one said formation being associated with one of the opposed surfaces of the disc and at least one said abutment being associated with the other of said opposed surfaces.

8. A dispenser bottle assembly as claimed in claim 7, wherein the corresponding formations comprise a recess in the base of the bottle and a corresponding lug on the drive member which is received in the recess and wherein the lug projects beyond the first opposed surface of the disc and the at least one abutment projects beyond the second opposed surface of the disc.

9. A dispenser bottle assembly as claimed in claim 8, wherein the collar has an annular surface aligned generally parallel to and facing the second opposed surface, an abutment projecting from the annular surface of the collar towards the second opposed surface of the disc.

10. A dispenser bottle assembly as claimed in claim 9, wherein the abutment on the collar is circumferentially offset from the abutment on the disc, the two abutments configured to contact one another to limit relative rotational movement between the collar and the drive member.

11. A dispenser bottle assembly as claimed in claim 1, wherein an air freshener dispenser is incorporated into the bottle.

12. A dispenser bottle assembly as claimed in claim 11, wherein the dispenser bottle comprises a main chamber for holding a liquid to be dispensed and a secondary chamber for holding an air freshener.

13. A dispenser bottle assembly comprising: a dispenser bottle having a base and a projection extending outwardly from the base; an externally threaded collar mounted for rotation about the projection; and a drive member mounted about the projection between the collar and the base of the bottle, the drive member comprising an annular disc having a first opposed surface directed toward the base of the bottle and a second opposed surface directed toward the collar, the base of the bottle defining at least one recess and the drive member having a corresponding lug on said first opposed surface receivable in the recess to hold the drive member rotationally fast with the bottle; the drive member having a first collar drive abutment on said second opposed surface which engages a corresponding second collar drive abutment on the collar only at specific relative rotational orientations of the drive member and the collar so that the drive member and the collar have a limited dree of rotational freedom relative to one another.

14. A dispenser bottle assembly as claimed in claim 13, wherein the collar has an annular surface aligned generally parallel to and facing the second opposed surface, the second collar drive abutment projecting from the annular surface of the collar towards the second opposed surface of the disc.

15. A dispenser bottle assembly as claimed in claim 14, wherein the second collar drive abutment on the collar is circumferentially offset from the first collar drive abutment on the drive member, the first and second collar drive abutments configured to contact one another to limit relative rotational movement between the collar and the member.

* * * * *